US005377903A

United States Patent [19]

Gordon et al.

[11] Patent Number: 5,377,903

[45] Date of Patent: Jan. 3, 1995

[54] REDUCED WARP PAPERBOARD TRAY

[75] Inventors: Robert L. Gordon, Monroe; George H. Naugle, Central Valley; David E. Stier, Middletown, all of N.Y.

[73] Assignee: International Paper Company, Purchase, N.Y.

[21] Appl. No.: 261,076

[22] Filed: Jun. 16, 1994

[51] Int. Cl.[6] ..... B65D 5/20

[52] U.S. Cl. ..... 229/116.1; 229/104; 229/931

[58] Field of Search ..... 229/8, 104, 930, 931, 229/3.1

[56] References Cited

U.S. PATENT DOCUMENTS

| | | | |
|---|---|---|---|
| 416,115 | 11/1889 | Mayall | 229/930 |
| 2,155,791 | 4/1939 | Holmes . | |
| 2,527,701 | 10/1950 | Buttery | 229/931 |
| 2,643,813 | 6/1953 | Vines | 229/931 |
| 2,932,439 | 4/1960 | Sparling | 229/931 |
| 3,062,429 | 11/1962 | Liman et al. . | |
| 3,526,566 | 9/1970 | McIwain, Jr. et al. | 229/930 |
| 3,927,823 | 12/1975 | Persson . | |
| 4,020,988 | 5/1977 | Kipp | 229/104 |
| 4,124,160 | 11/1978 | Meyers et al. | 229/8 |
| 4,308,985 | 1/1982 | Manizza et al. . | |
| 4,792,085 | 12/1988 | Waring, III et al. . | |
| 4,951,865 | 8/1990 | Eisman . | |
| 5,022,582 | 6/1991 | Ritter . | |

FOREIGN PATENT DOCUMENTS

| | | | |
|---|---|---|---|
| 364220 | 10/1962 | Cyprus | 229/8 |
| 5254535 | 10/1993 | Japan | 229/930 |
| 927238 | 5/1963 | United Kingdom | 229/8 |
| 7900170 | 4/1979 | WIPO | 229/930 |

*Primary Examiner*—Gary E. Elkins

*Attorney, Agent, or Firm*—Michael J. Doyle; Paul R. Juhasz

[57] ABSTRACT

A paperboard tray which resists warping is formed of a unitary blank, the blank having a polymer coating on its tray interior forming surface. The polymer coating is typically a heat resistant, non-stick, FDA approved polymer applied by extrusion coating. The upstanding sidewalls of the tray are joined to respective peripheral portions of the tray base through curved score lines on the tray interior surface. Curved cut lines on the exterior tray surface are each aligned with respective curved score lines on the tray interior surface, the cut lines extending 75 to 90 percent through the blank. The curved score lines and their complementary cut lines may be curved either convex outwardly or concavely inwardly with respect to the tray base.

18 Claims, 2 Drawing Sheets

REDUCED WARP PAPERBOARD TRAY

BACKGROUND OF THE INVENTION

This invention relates to a paperboard tray exhibiting reduced warping. A continuing problem of paperboard tray warp or torquing has resulted in interruption of packaging operations. Paperboard trays, coated on their interior surface by polyesters or nylons, are often used to package and transport frozen food products such as biscuits from the producer to the end use fast food chain. These trays are formed from flat die cut blanks into locked corner trays having vertical sidewalls. Because of inherent paperboard stiffness and springback of the sidewall panel score lines, the formed trays tend to warp from corner to corner. When warping occurs the empty trays will not convey on equipment of the packager and down time and loss of product occurs.

SUMMARY OF THE INVENTION

According to the practice of this invention, the tray is formed of paperboard coated with a non-stick material on the paperboard side next to the product stored or packaged in the tray. This coating may be laminated or extruded or otherwise coated and may be any of known heat resistant, non-stick, FDA food grade approved formulations such as that marketed under the trade name QRX TM by International Paper Co. One such construction is shown and described in U.S. Pat. No. 5,002,833 issued Mar. 26, 1991 to J. L. Kinsey et al and assigned to International Paper Co., hereby incorporated by reference. Paperboard coated with suitable polyesters, nylons, or other polymers may be used in carrying out the present invention. In order to eliminate warping, the intersecting score lines between the tray base and the vertical sidewall panels, each of which defines one edge of each sidewall, are changed from straight score lines to a slightly arcuate score lines. When formed into a tray from a flat die cut blank, these arcs create a resistance or downward force that in turn keeps the formed or erected tray flat. For a tray about 15 inches by 12 inches the maximum departure of the longest arc from a straight line is about one-eighth inch. This dimension will proportionally increase as a tray sidewall increases in length and decreases as it is made smaller.

In conjunction with each arc, respective cuts, such as micro cuts, are provided. The cuts extend from the outside or exterior tray surface towards the tray interior, each cut being about 75–90% through the paperboard and aligned with and congruent to respective ones of the curved or arcuate score lines. The combination of (outside) cuts and (inside) curved scores reduces the springback force of the board and polymer.

The curved score lines on the interior surface of the tray may be either convex radially outwardly relative to the tray base, or alternatively, they may be concave radially inwardly relative to the tray base.

DETAILED DESCRIPTION OF THE INVENTION

Figure 1:
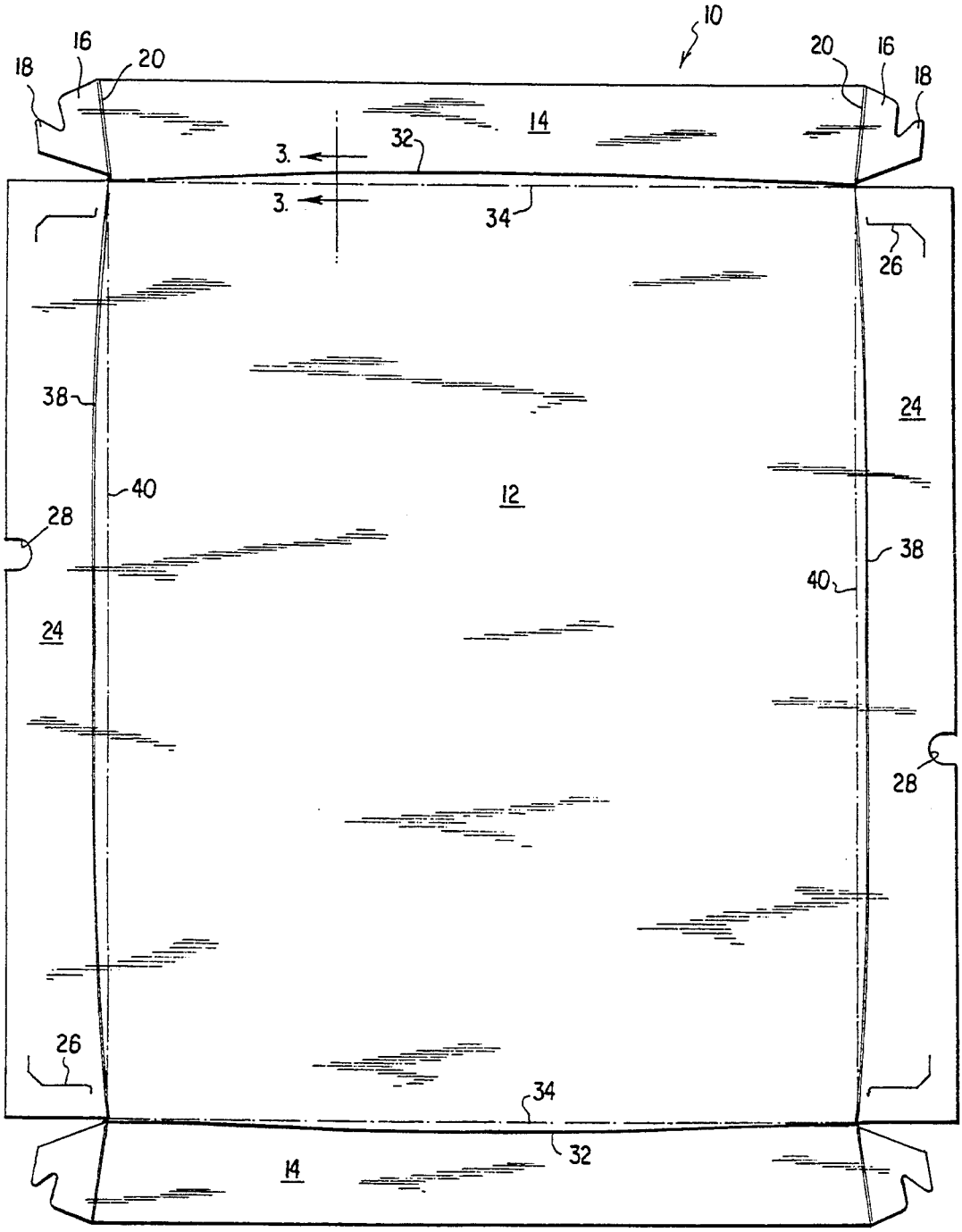
FIG. 1 is a plan view of a unitary blank of paperboard from which the reduced warp tray of this invention is formed.

Referring now to FIG. 1 of the drawings, a unitary blank of paperboard or other stiff, foldable, and resilient sheet material is illustrated and denoted as 10. The blank includes a central tray base forming panel 12 and upper and lower end side wall panels 14. Panels 14 are identical in construction, with each such panel having an end flap or tongue 16 carrying a tip 18, with flaps or tongues 16 foldably secured to each sidewall forming panel 14 by a score line 20. Each of two longitudinal side wall forming panels 24 is provided at its respective upper and lower portions with a slit 26, with each slit extending completely through the paperboard. Side wall panels 14 may, if desired, be provided with free edge cutouts 28 to assist in the automated handling of the trays and blanks, it being understood that the cutouts 28 form no part of this invention.

Each side wall panel 14 is integrally joined to base forming panel 12 at a curved score line or arc 32, with the extent and direction of the arc shown by a corresponding straight line 34 running from corner to corner. Similarly, each side wall panel 24 is coupled to base forming panel 12 through a curved score line 38, with respective straight lines 40, running from corner to corner, indicating the direction and extent of the curvature. It will be observed that curved score lines 32 and 38 are radially outwardly convex with respect to base 12.

Figure 2:
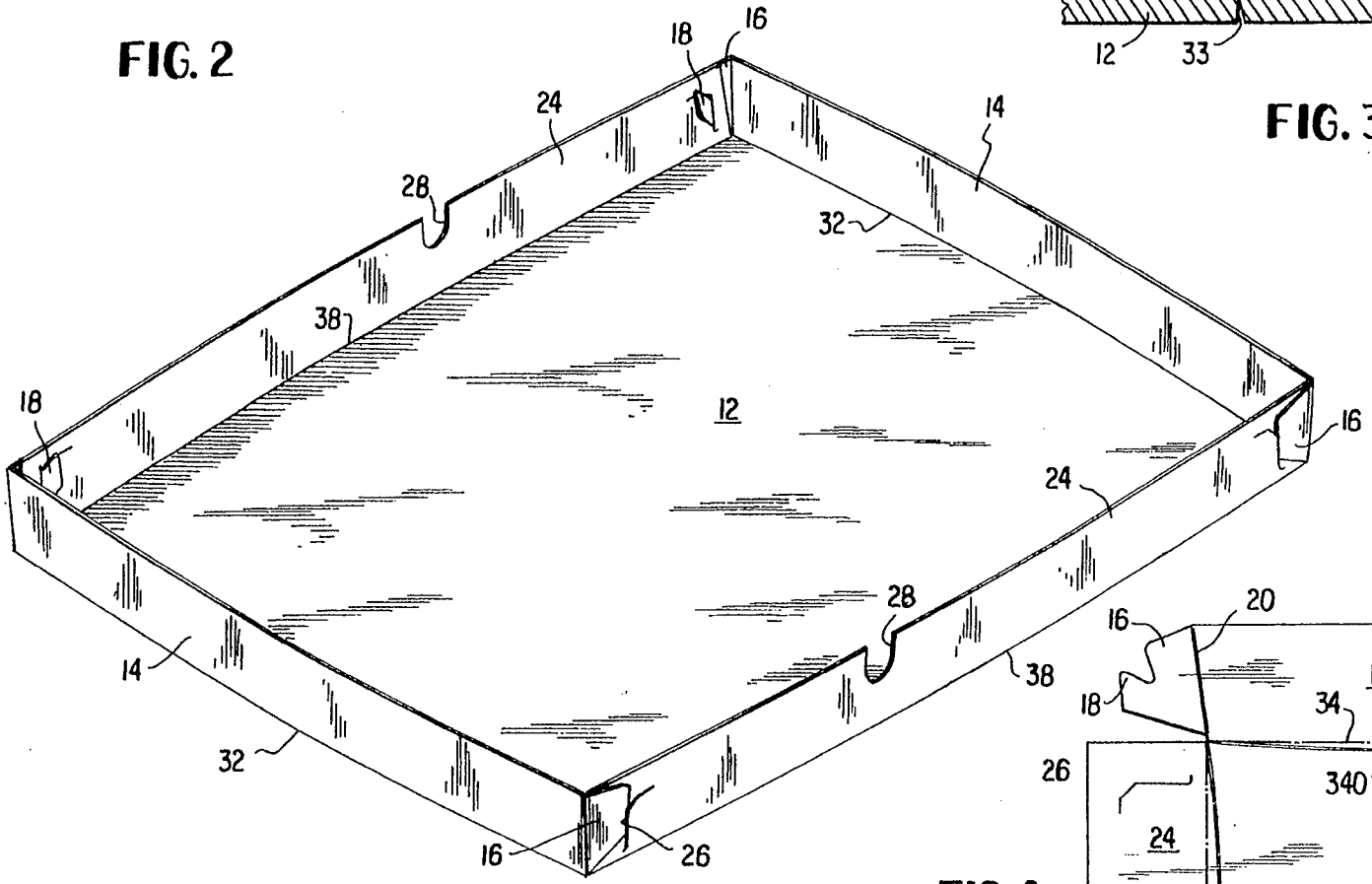
FIG. 2 is a perspective view showing a tray fashioned from the blank of FIG. 1.

Referring now to FIG. 2, sidewalls 14 and 24 of FIG. 1 have been folded along curved score lines 32 and 38, with tongue tips 18 inserted through slits 26 to maintain adjacent ends of the sidewall panels together. It will be understood that the exact form of flaps 16 and slits 26 plays no role in the invention, with the adjacent end portions of the sidewalls joined together in any desired manner. Elements 16, 18 and 26 may be regarded as means for joining adjacent ends of different sidewalls to each other.

Figure 3:
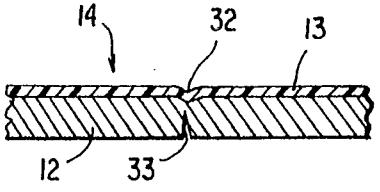
FIG. 3 is a view taken along Section 3—3 of FIG. 1 and illustrates the relation between the interior curved scores and the outside cut lines.

Referring now to FIG. 3, this sectional view illustrates a non-stick, heat resistant, FDA (U.S. Food And Drug Administration) approved polymer material or formulation 13, of any such known composition, applied to the interior forming surface of the blank of FIG. 1 (which faces the reader) in any known manner. If the tray is not to be used for containing foods, then non-FDA approved polymers may be employed. Similarly, the polymer need not be heat resistant or non-stick if the tray will not be subject to elevated temperatures and a non-stick property is not required. FIG. 3 illustrates that each curved score line 32 on the tray interior surface is aligned with and is congruent to a respective curved cut line 33. While not shown at FIG. 3, it will be readily visualized that similar cut lines on the bottom of the blank, away from the reader of FIG. 1, are congruently associated with each of the curved score lines 38 for the longer sidewall panels 24. Thus, each curved score line is congruently paired with a curved or arcuate cut line.

Figure 4:
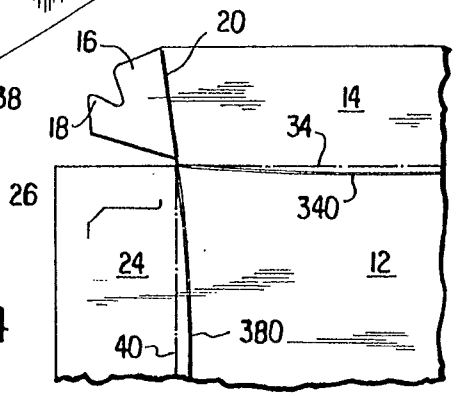
FIG. 4 is a partial view of an alternative embodiment wherein the score lines on the tray interior surface are concave radially with respect to the tray base.

Referring now to FIG. 4, a partial plan view, similar to FIG. 1, shows another embodiment wherein the tray interior curved or arcuate score lines are bowed in the opposite direction. There, curved score lines denoted as 320 and 380 on the tray interior are concave, i.e., bowing towards base 12 as opposed to bowing away from it as shown at FIG. 1. Here again, there is a congruent curved cut line (not illustrated) on the tray exterior for each curved score line on the tray interior. A tray formed as shown in FIG. 4 is also provided with a polymer coating on its interior surface.

We claim:

1. A flat unitary blank of paperboard having a plurality of intersecting score lines on a first of two surfaces of said blank, said first of said two surfaces having a polymer coating thereon, said score lines enclosing and defining a base for a tray, a plurality of tray sidewall forming panels located radially outwardly of said base, each said sidewall forming panel bordered by one of said score lines, each said score line being curved, a plurality of cut lines on the other of said two surfaces of said blank, said cut lines each extending into said blank from said other of said two blank surfaces and toward said first of said two blank surfaces, said score and cut lines being at least substantially aligned.

2. The blank of claim 1 wherein said curved score lines are convex radially outwardly relative to said base.

3. The blank of claim 1 wherein said curved score lines are concave radially inwardly relative to said base.

4. The blank of claim 1 wherein said sidewall forming panels have ends and wherein said ends carry means for coupling each of them to another, adjacent sidewall forming panel.

5. The blank of claim 1 wherein said blank has four said sidewall forming panels and wherein said base is rectangular.

6. The blank of claim 1 wherein said cut lines extend about 75 to 90 percent through said blank.

7. The blank of claim 2 wherein said cut lines extend about 75 to 90 percent through said blank.

8. The blank of claim 3 wherein said cut lines extend about 75 to 90 percent through said blank.

9. The blank of claim 7 wherein said polymer coating is a heat resistant, non-stick, FDA approved polymer.

10. The blank of claim 8 wherein said polymer coating is a heat resistant, non-stick, FDA approved polymer.

11. The blank of claim 8 wherein said polymer coating is a heat resistant, non-stick, FDA approved polymer.

12. A tray formed from a unitary blank of paperboard, said tray having a generally flat central base surrounded by upstanding sidewalls, said sidewalls joined through respective score lines to said base, said tray and sidewalls having an inner surface adapted to hold a product, and having an outer surface, said score lines being on said inner tray surface, said inner tray surface having a polymer coating thereon, said score lines being curved, a plurality of cut lines on said tray outer surface, each of said cut lines being at least substantially aligned with a respective said curved score line.

13. The tray of claim 12 including means for joining adjacent said sidewalls to each other.

14. The tray of claim 12 wherein said curved score lines are convex radially outwardly relative to said base.

15. The tray of claim 12 wherein said curved score lines are concave radially inwardly relative to said base.

16. The tray of claim 12 wherein said cut lines extend about 75 to 90 percent through said blank.

17. The tray of claim 12 wherein said polymer is a heat resistant, non-stick, FDA approved polymer.

18. The tray of claim 16 wherein said polymer is a heat resistant, non-stick, FDA approved polymer.

* * * * *